US006342759B1

(12) United States Patent
Hosotani

(10) Patent No.: US 6,342,759 B1
(45) Date of Patent: Jan. 29, 2002

(54) COLOR CATHODE RAY TUBE HAVING AN IMPROVED PHOSPHOR SCREEN

(75) Inventor: Nobuhiko Hosotani, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/548,672

(22) Filed: Apr. 13, 2000

Related U.S. Application Data

(63) Continuation of application No. 09/089,514, filed on Jun. 3, 1998, now Pat. No. 6,064,147.

(30) Foreign Application Priority Data

Jun. 3, 1997 (JP) ..... 9-145279

(51) Int. Cl.[7] ..... H01J 29/10
(52) U.S. Cl. ..... 313/463; 313/402
(58) Field of Search ..... 313/463, 402

(56) References Cited

FOREIGN PATENT DOCUMENTS

| | | | |
|---|---|---|---|
| JP | 56-41648 | 4/1981 | |
| JP | 59-7553 | 1/1984 | ..... H01J/29/07 |
| JP | 61-153927 | 7/1986 | ..... H01J/29/07 |
| JP | 61-158651 | 7/1986 | ..... H01J/29/32 |
| JP | 61-45343 | 10/1986 | |
| JP | 62-58548 | 3/1987 | ..... H01J/29/07 |
| JP | 4-249039 | 9/1992 | ..... H01J/29/07 |
| JP | 5-82044 | 4/1993 | ..... H01J/29/07 |
| JP | 6-044921 | 2/1994 | ..... H01J/29/18 |
| JP | 6-275206 | 9/1994 | ..... H01J/29/07 |
| JP | 8-017357 | 1/1996 | ..... H01J/29/07 |
| JP | 9-082234 | 3/1997 | ..... H01J/29/07 |
| JP | 9-082236 | 3/1997 | ..... H01J/29/07 |
| JP | 9-134677 | 5/1997 | ..... H01J/29/07 |

*Primary Examiner*—Nimeshkumar D. Patel
*Assistant Examiner*—Thelma Sheree Clove
(74) *Attorney, Agent, or Firm*—Antonelli, Terry, Stout & Kraus, LLP

(57) ABSTRACT

A color cathode ray tube having an evacuated envelope including a panel portion, a neck portion and a funnel portion for connecting the panel portion and the neck portion. The panel portion includes a faceplate, a plural-color phosphor screen formed on an inner surface of the faceplate and having a multiplicity of phosphor dots of a plurality of colors. A shadow mask has a multiplicity of apertures therein and spaced from the phosphor screen and a plural-beam in-line type electron gun is housed in the neck portion. The plural-color phosphor screen is configured such that a first horizontal phosphor dot pitch Ph on a horizontal center line of a useful area of the phosphor screen at a first predetermined distance from a center of the useful area of the phosphor screen toward sides of the useful area is less than or equal to 101% of a second horizontal phosphor dot pitch Ph at the center of the useful area, wherein the first predetermined distance is two-thirds of a distance from the center of the useful area to the sides of the useful area. A third horizontal phosphor dot pitch Ph at corners of the useful area is larger than the second horizontal phosphor dot pitch Ph at the center of the useful area and a first vertical phosphor dot pitch Pv at the corners of the useful area is smaller than a second vertical phosphor dot pitch Pv at the center of the useful area.

7 Claims, 5 Drawing Sheets

COLOR CATHODE RAY TUBE HAVING AN IMPROVED PHOSPHOR SCREEN

CROSS REFERENCE TO RELATED APPLICATION

This is a continuation of U.S. application Ser. No. 09/089,514, filed Jun. 3, 1998 now U.S. Pat. No. 6,064,147, the subject matter of which is incorporated by reference herein.

BACKGROUND OF THE INVENTION

The present invention relates to a shadow mask type color cathode ray tube, and particularly to a color cathode ray tube having a multiplicity of dot-like electron-transmissive apertures (will be also referred to as beam apertures or simply as apertures in this specification) in the useful apertured portion of the shadow mask with horizontal and vertical pitches of the apertures varied and providing a high quality display.

In general, in a shadow mask type color cathode ray tube, a multiplicity of beam apertures are formed in the apertured portion of the shadow mask in correspondence with the shape and position of the three-color phosphor screen formed on the inner surface of the faceplate of the panel portion.

The beam apertures in the shadow mask are arranged with horizontal and vertical aperture pitches determined by some formula such that triads of red, green and blue phosphor picture elements are arranged in predetermined positions.

As such a prior art shadow mask type color cathode ray tube, there are known those in which the aperture pitches of beam apertures in the apertured portion of the shadow mask are determined by the following formulas on the basis of the slightly curved shapes of the inner surface of the faceplate and the apertured portion of the shadow mask.

In one example, the horizontal aperture pitches are nearly uniform in a central portion on both sides of and in the neighborhood of the vertical center line of the apertured portion, and become progressively greater as the left or right side of the apertured portion is approached outside of the central portion. This type is hereinafter referred to as a prior art shadow mask of the first type.

In another example, as disclosed in Japanese Patent Laid-Open Publication No. SHO 56-41648, the vertical aperture pitches of the beam apertures become progressively smaller as one goes from the horizontal center line toward the top or bottom of the apertured portion and from the vertical center line toward the left or right side of the apertured portion at the same time. This type is hereinafter referred to as a prior art shadow mask of the second type.

In a color cathode ray tube employing the prior art shadow mask of the second type, the phosphor screen is configured such that the line triads of the three phosphor dots of red, green and blue colors tilt increasingly with respect to a horizontal direction as one goes from the horizontal center line toward the top or bottom of the useful phosphor screen area and from the vertical center line toward the left or right side of the useful phosphor screen area at the same time.

FIG. 5 is a plan view showing an arrangement of part of phosphor dots in the useful phosphor screen area of a color cathode ray tube employing the shadow mask of the second type (disclosed in Japanese Patent Laid-Open Publication No. SHO 56-41648).

In FIG. 5, reference numeral 31 designates a faceplate; 32 is a useful phosphor screen area; 33 is phosphor dots; 33R is red phosphor dots; 33G is green phosphor dots; 33B is blue phosphor dots; 34 is the vertical center line (Y axis) of the useful phosphor screen area 32; and 35 is the horizontal center line (X axis) of the useful phosphor screen area 32.

The faceplate 31 has a multiplicity of phosphor dots 33 in the useful phosphor screen area 32 on the inner surface thereof. The phosphor dots 33 are composed of a plurality of triads and one red phosphor dot 33R, one green phosphor dot 33G and one blue phosphor dot 33B form one triad.

As shown in FIG. 5, the phosphor dots 33 are arranged with nearly uniform horizontal and vertical pitches such that the line triads of the three-color phosphor dots 33 tilt increasingly with decreasing distance from the corners of the useful phosphor screen area 32, with respect to the horizontal center line 35.

Specifically, the line triads of the three-color phosphors are nearly horizontal in each of the following portions in the useful phosphor screen area 32: the approximately central portion and its neighborhood; the portion extending on the horizontal center line 35 from approximately the center to the right and left sides and its neighborhood; and the portion extending on the vertical center line 34 from approximately the center to the top and bottom and its neighborhood. At the four corner portions in the useful phosphor area 32, the line triads of the three-color phosphors 33 tilt most largely with respect to the horizontal center line 35 and tilt decreasingly with respect to the horizontal center line 35 with increasing distance from the four corner portions. The tilt of the line triads of the three-color phosphors 33 with respect to the horizontal center line 35 at the four corner portions have upward slopes at the upper left-hand corner, downward slopes at the upper right-hand corner, downward slopes at the lower left-hand corner and upward slopes at the lower right-hand corner. In the following description, such an arrangement of a multiplicity of the phosphor dots 33 on the faceplate 31 is referred to as a tilt array arrangement.

In the color cathode ray tubes employing the prior art shadow mask of the first type, a multiplicity of the phosphor dots formed in the useful phosphor screen area are arranged with the horizontal aperture pitch nearly uniform in the portion on both sides and in the neighborhood of the vertical center line, and with dot pitches progressively greater toward the left or right side of the useful phosphor screen area out of the central portion. Accordingly, horizontal and diagonal pitches between two adjacent triads of phosphor dots at portions at sides and corners of the useful phosphor screen area become greater, respectively. As a result, the color cathode ray tubes employing the prior art shadow mask of the first type have a disadvantage that the resolution is deteriorated at portions at sides and corners of the phosphor screen.

In the color cathode ray tubes employing the prior art shadow mask of the second type, since the phosphor dots formed in the useful phosphor screen area are arranged in a tilt array arrangement, diagonal pitches between two adjacent triads of phosphor dots at portions at corners in the useful phosphor screen area become smaller. As a result, the color cathode ray tubes employing the prior art shadow mask of the second type have a disadvantage that the color purity tolerance at each corner portion on the phosphor screen is reduced, leading to the non-uniformity in displayed colors.

SUMMARY OF THE INVENTION

An object of the present invention is to solve the above-mentioned problems and to provide a shadow mask type color cathode ray tube capable of increasing the color purity tolerance at each portion on the phosphor screen so as to prevent deterioration of the resolution, and retaining the mechanical strength of the shadow mask.

To achieve the above object, according to the shadow mask type color cathode ray tube of the present invention, beam apertures of the shadow mask are arranged such that the horizontal aperture pitches are nearly uniform in a central portion on both sides of and in the neighborhood of the vertical center line of the apertured portion and increase slightly with increasing distance from the central portion toward the left or right side of the apertured portion, and such that the vertical aperture pitches are arranged in such a manner as to slightly increase the tilt of the horizontal rows of the beam apertures as one goes from the vertical center line toward the left or right side of the apertured portion.

Here, the phosphor dots of the phosphor screen are arranged in such a manner as to satisfy the following relationship:

$$0.98\ Pdo \leqq Pd \leqq 1.02\ Pdo \quad (1)$$

where $Pd=\{Ph^2+Pv^2\}^{0.5}$, and where, consider two closest phosphor dots of the same color one on each of the two adjacent horizontal rows of the phosphor dots in the phosphor screen, a horizontal dot pitch Ph is a distance between the two phosphor dots of the same color measured horizontally, a vertical dot pitch Pv is a distance between the two phosphor dots of the same color measured vertically, a diagonal dot pitch Pd is a diagonal distance between the two phosphor dots of the same color, and a central diagonal dot pitch Pdo is a diagonal dot pitch Pd measured at the central portion of the phosphor screen.

With this configuration, the arrangement of the beam apertures in the apertured portion of the shadow mask is such that the vertical aperture pitches are arranged to form a tilt array arrangement and the horizontal pitches of the beam apertures are nearly uniform in the central portion on both sides of and in the neighborhood of the vertical center line of the apertured portion and increase slightly with increasing distance from the central portion toward the left or right side of the apertured portion to form a varied pitch arrangement.

The varied pitch arrangement of the beam apertures cancels the decrease in diagonal pitches of the phosphor dots at the corners of the phosphor screen caused by the tilt array arrangement of the aperture pitches and the relationship (1) above makes the diagonal pitches of the phosphor dots nearly uniform over the entire useful phosphor screen area. Accordingly, it is possible to increase a color purity tolerance at each portion in the phosphor screen, and hence to prevent local deterioration in resolution.

BRIEF DESCRIPTION OF THE DRAWINGS

The drawings form an integral part of the specification and are to be read in conjunction therewith, in which like reference numerals designate similar components throughout the-figures, and in which:

FIGS. 2A and 2B are configuration views showing one configuration example of a shadow mask for use in the color cathode ray tube shown in FIG. 1, wherein FIG. 2A is a perspective view of the shadow mask and FIG. 2B is a plan view thereof;

FIGS. 4A, 4B and 4C are characteristic diagrams showing variations in pitches of the phosphor dots of the phosphor screen formed on the inner surface of the faceplate for use in the color cathode ray tube shown in FIG. 1, wherein FIG. 4A shows one example of the horizontal dot pitches, and FIGS. 4B and 4C shows two different examples of the vertical dot pitches, respectively.

DETAILED DESCRIPTION OF THE PREFERRED EMBODIMENTS

Figure 1:
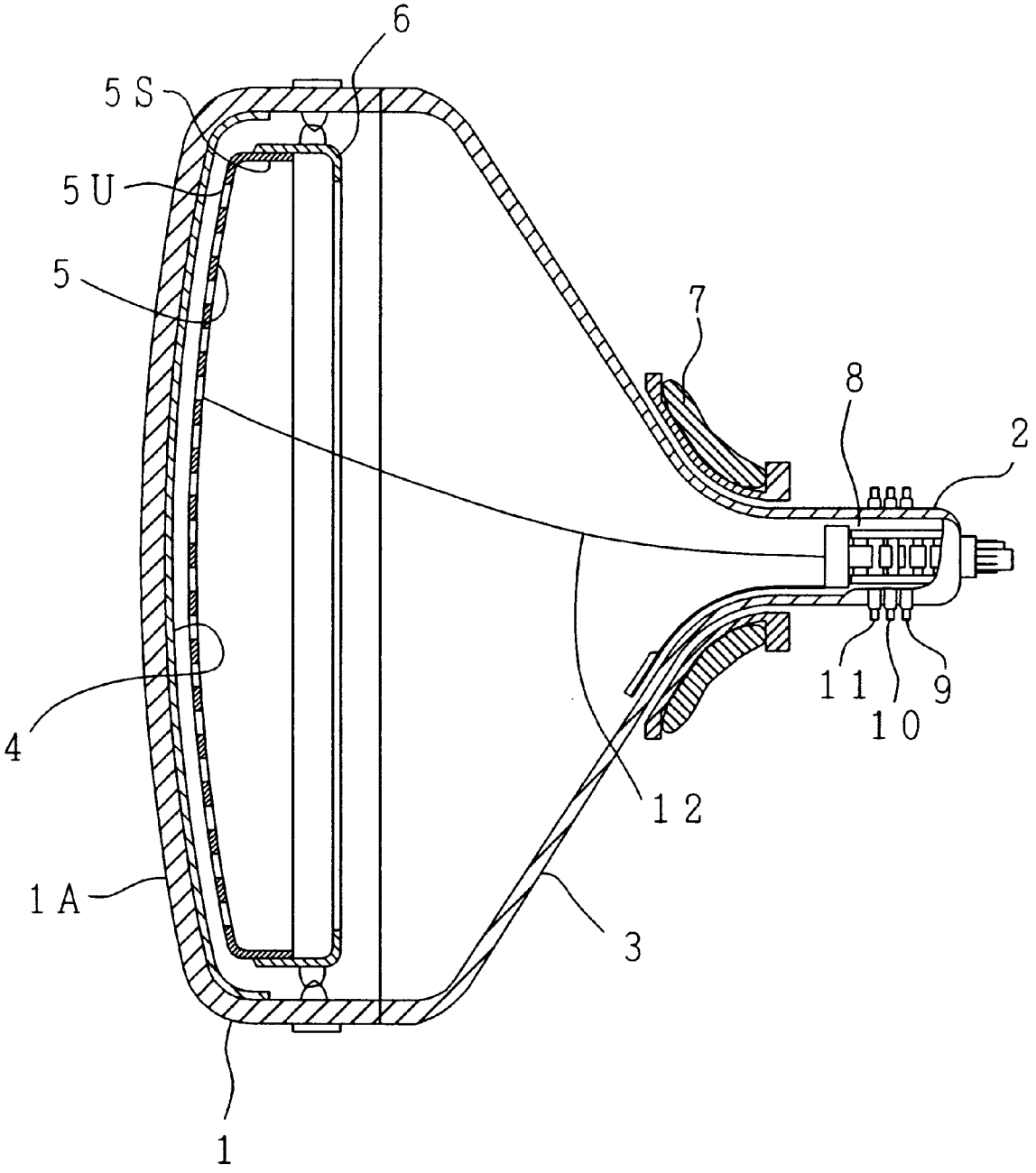
FIG. 1 is a sectional view showing a schematic configuration of one embodiment of a color cathode ray tube of the present invention.

A shadow mask type color cathode ray tube of the present invention includes a phosphor screen formed on the inner surface of a faceplate of a panel portion; a shadow mask closely spaced from the phosphor screen within the panel portion; and an in-line type electron gun housed in a neck portion. The shadow mask has a multiplicity of dot-like beam apertures in an apertured portion. The horizontal aperture pitches are nearly uniform in a central portion on both sides of and in the neighborhood of the vertical center line of the apertured portion and increase slightly with increasing distance from the central portion toward the left or right side of the apertured portion. The vertical aperture pitches decrease slightly as one goes from the vertical center line toward the left or right side of the apertured portion.

Here, the phosphor dots of the phosphor screen are arranged in such a manner as to satisfy the following relationship:

$$0.98\ Pdo \leqq Pd \leqq 1.02\ Pdo \quad (1)$$

where $Pd=\{Ph^2+Pv^2\}^{0.5}$, and where, consider two closest phosphor dots of the same color one on each of the two adjacent horizontal rows of the phosphor dots in the phosphor screen, a horizontal dot pitch Ph is a distance between the two phosphor dots of the same color measured horizontally, a vertical dot pitch Pv is a distance between the two phosphor dots of the same color measured vertically, a diagonal dot pitch Pd is a diagonal distance between the two phosphor dots of the same color, and a central diagonal dot pitch Pdo is a diagonal dot pitch Pd measured at the central portion of the phosphor screen.

According to the shadow mask type color cathode ray tube of the present invention, the arrangement of the beam apertures in the apertured portion of the shadow mask is such that the vertical aperture pitches are arranged to form a tilt array arrangement and the horizontal pitches of the beam apertures are nearly uniform in the central portion on both sides of and in the neighborhood of the vertical center line of the apertured portion and increase slightly with increasing distance from the central portion toward the left or right side of the apertured portion to form a varied pitch arrangement. As a result, the varied pitch arrangement of the beam apertures cancels the decrease in diagonal pitches of the phosphor dots at the corners of the phosphor screen caused by the tilt array arrangement of the aperture pitches. Further, the relationship (1) between the horizontal dot pitch Ph, vertical dot pitch Pv, diagonal dot pitch Pd, and central diagonal dot pitch Pdo at the center of the phosphor screen makes the diagonal pitches of the phosphor dots substantially uniform over the entire useful phosphor screen area. As a result, a color purity tolerance increases at each portion of the phosphor screen, and local deterioration in resolution does not occur.

In the shadow mask type color cathode ray tube of the present invention, the varied aperture pitch arrangement in the shadow mask is effective to increase the mechanical strength of the shadow mask.

Hereinafter, embodiments of the present invention will be described with reference to the drawings.

FIG. 1 is a sectional view showing a schematic configuration of an embodiment of a color cathode ray tube of the present invention.

In FIG. 1, reference numeral 1 designates a panel portion; 1A is a faceplate; 2 is a neck portion; 3 is a funnel portion; 4 is a phosphor screen; 5 is a shadow mask; 5U is an apertured portion; 5S is a skirt portion; 6 is a support frame; 7 is a deflection yoke; 8 is an in-line type electron gun; 9 is a purity adjustment magnet; 10 is a four-pole static beam convergence adjustment magnet; 11 is a six-pole static beam adjustment magnet; and 12 is an electron beam.

An evacuated envelope (glass bulb) of the color cathode ray tube is composed of a panel portion 1 having a large-diameter faceplate 1A; a narrow tubular neck portion 2 housing the in-line type electron gun 8; and a funnel portion 3 for connecting the panel portion 1 to the neck portion 2. The panel portion 1 has the phosphor screen 4 formed on the inner surface of the faceplate 1A. The skirt portion 5S of the shadow mask 5 is welded to the support frame 6 which in turn is fixed to the inner sidewall of the panel portion 1 such that the apertured portion 5U of the shadow mask 5 faces the phosphor screen 4. The deflection yoke 7 is mounted around the funnel portion 3 on the side thereof closer to the neck portion 2.

The three electron beams 12 (only one of which is shown in FIG. 1) emitted from the in-line type electron gun 8 are deflected by the deflection yoke 7, pass through an aperture in the shadow mask 5 and impinge upon the phosphor dots of the corresponding colors in the phosphor screen 4. The purity adjustment magnet 9, four-pole static beam convergence adjustment magnet 10 and six-pole static beam convergence adjustment magnet 11 are juxtaposed around the neck portion 2.

The image displaying operation of the color cathode ray tube in this embodiment is substantially the same as that of a prior art color cathode ray tube of this type, and therefore, explanation thereof is omitted.

Figure 2A:
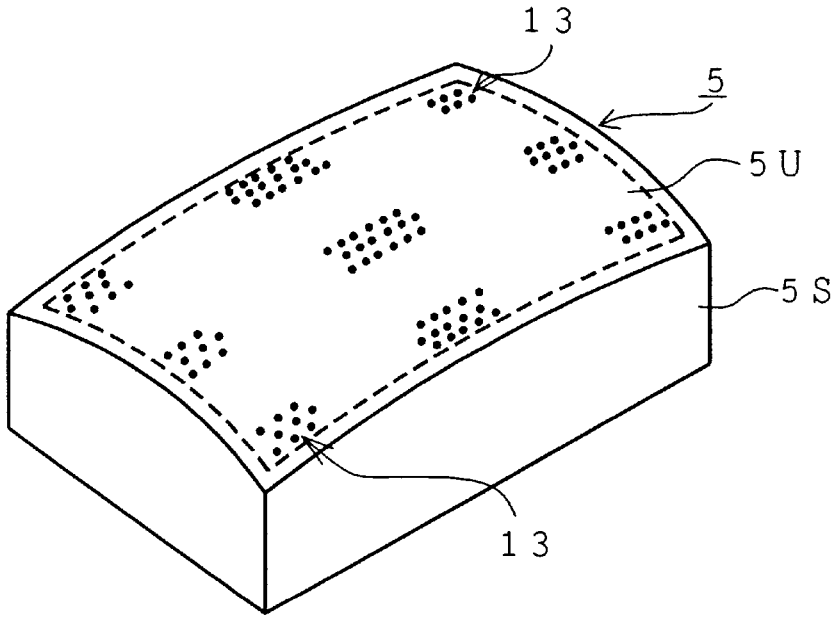
Figure 2B:
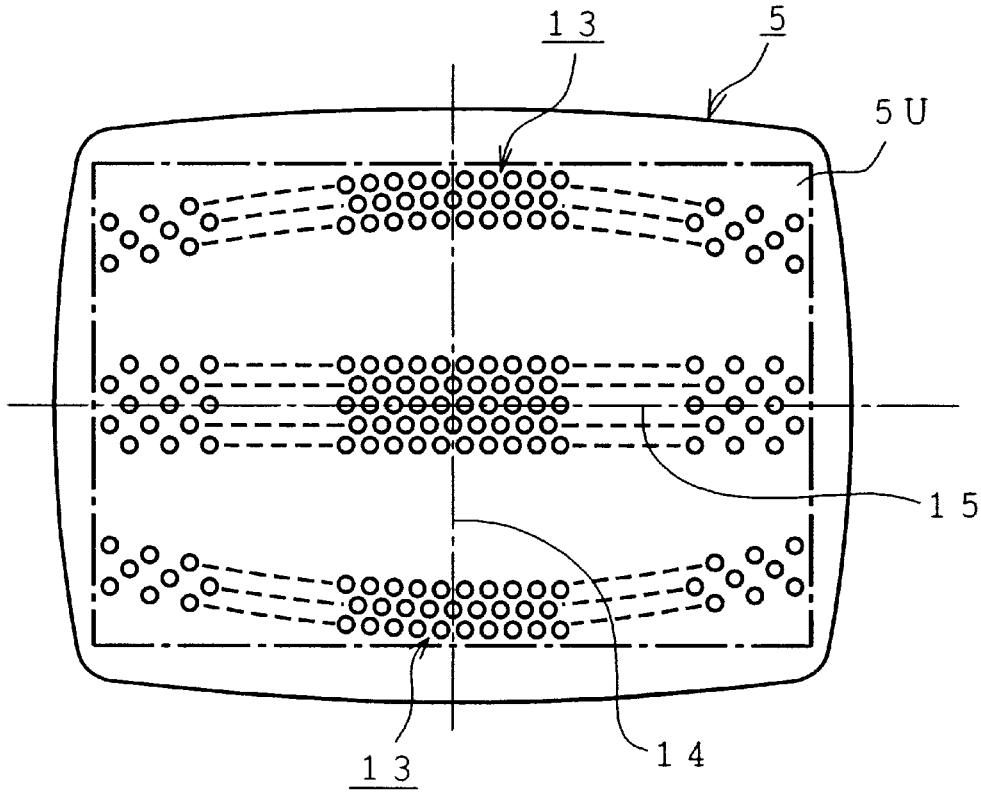

FIGS. 2A and 2B are configuration views showing one configuration example of the shadow mask for use in the color cathode ray tube shown in FIG. 1, wherein FIG. 2A is a perspective view showing the overall configuration of the shadow mask, and FIG. 2B is a plan view showing an arrangement of a multiplicity of beam apertures formed in an apertured portion.

In FIGS. 2A and 2B, reference numeral 13 designates a multiplicity of dot-like beam apertures formed in the apertured portion 5U of the shadow mask 5; 14 is a vertical center line of the shadow mask 5 (apertured portion 5U); and 15 is the horizontal center line of the shadow mask 5 (apertured portion 5U). In addition, the same reference numerals as utilized in FIG. 1 designate corresponding portions in FIGS. 2A and 2B.

As shown in FIG. 2B, in the shadow mask 5 for use in the color cathode ray tube, a multiplicity of the beam apertures 13 are formed in the apertured portion like the prior art shadow mask.

In the shadow mask 5 in this embodiment, the arrangement of the beam apertures 13 in the apertured portion 5U of the shadow mask is such that the horizontal pitches of the beam apertures 13 are nearly uniform in a central portion on both sides of and in the neighborhood of the vertical center line 14 of the apertured portion and increase slightly as one goes out of the central portion toward the left or right side of the apertured portion 5U to form a varied pitch arrangement and the vertical aperture pitches of the beam apertures 13 decrease slightly as one goes from the vertical center line 14 toward the left or right side of the apertured portion 5U, to form a varied pitch arrangement.

In other words, the horizontal direction of the arrangement of the beam apertures 13 tilt slightly increasingly with respect to the horizontal center line 15 as one goes from the central portion toward the corners of the apertured portion 5U.

In this case, the tilt angle of the horizontal direction of the arrangement of the beam apertures 13 with respect to the horizontal center line 15 is largest at the four corners of the apertured portion 5U and decreases with increasing distance from the four corners.

And the horizontal direction of the arrangement of the beam apertures 13 with respect to the horizontal center line 15 is upward-sloping at the upper left-hand corner, downward-sloping at the upper right-hand corner, downward-sloping at the lower left-hand corner and upward-sloping at the lower right-hand corner to form a so-called tilt array arrangement.

Figure 3:
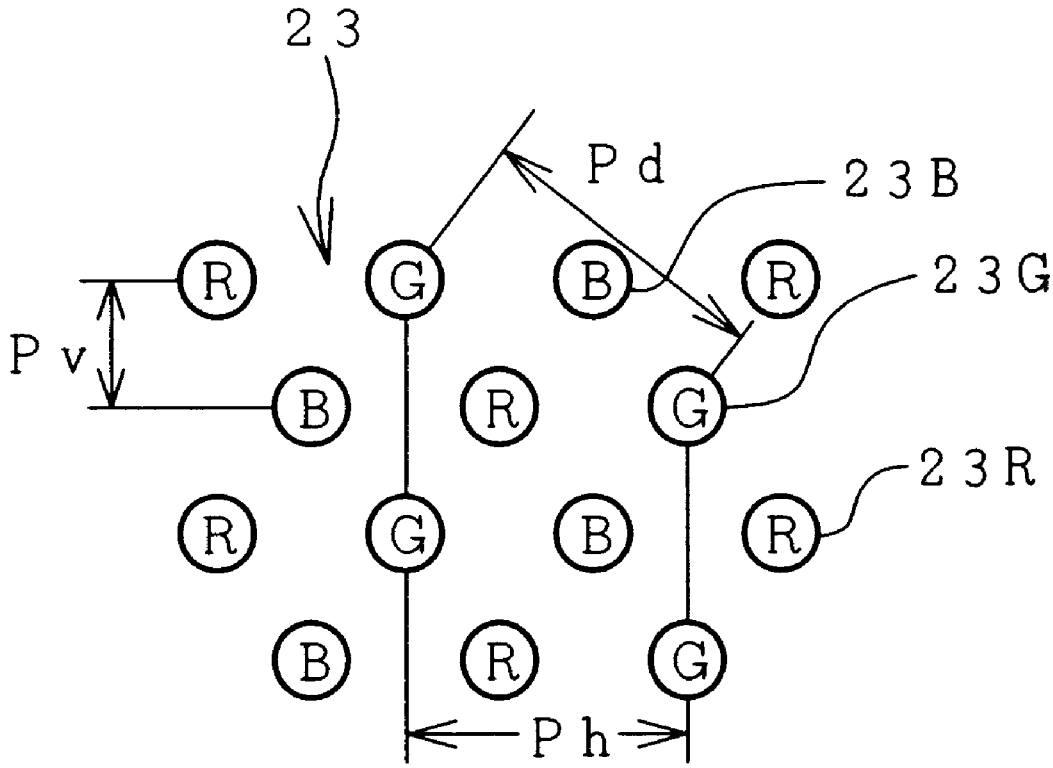
FIG. 3 is a view illustrating the definition of horizontal, vertical and diagonal pitches of phosphor dots of the phosphor screen formed on the inner surface of a faceplate of a panel portion for use in the color cathode ray tube shown in FIG. 1.

FIG. 3 is a view illustrating horizontal, vertical and diagonal pitches of the phosphor dots of the phosphor screen formed on the inner surface of the faceplate of the panel portion for use in the color cathode ray tube of FIG. 1 employing the shadow mask as shown in FIGS. 2A and 2B.

Figure 4A:
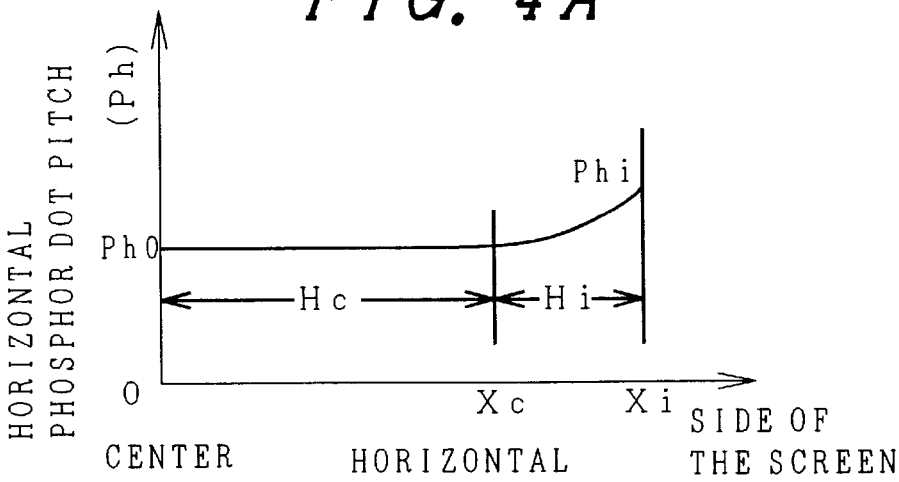
Figure 4B:
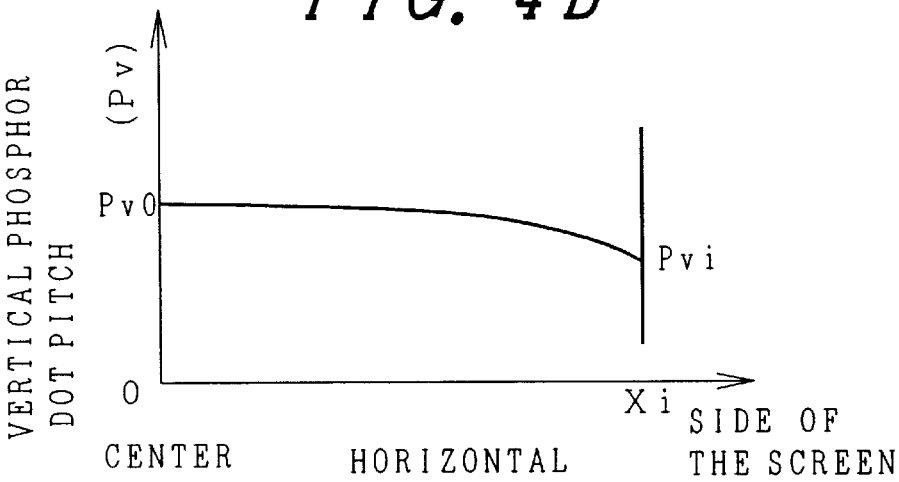
Figure 4C:
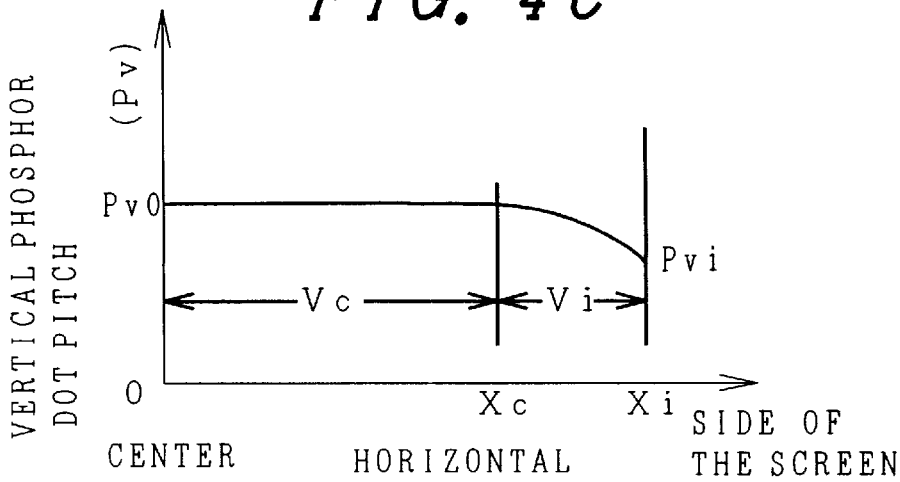
Figure 5:
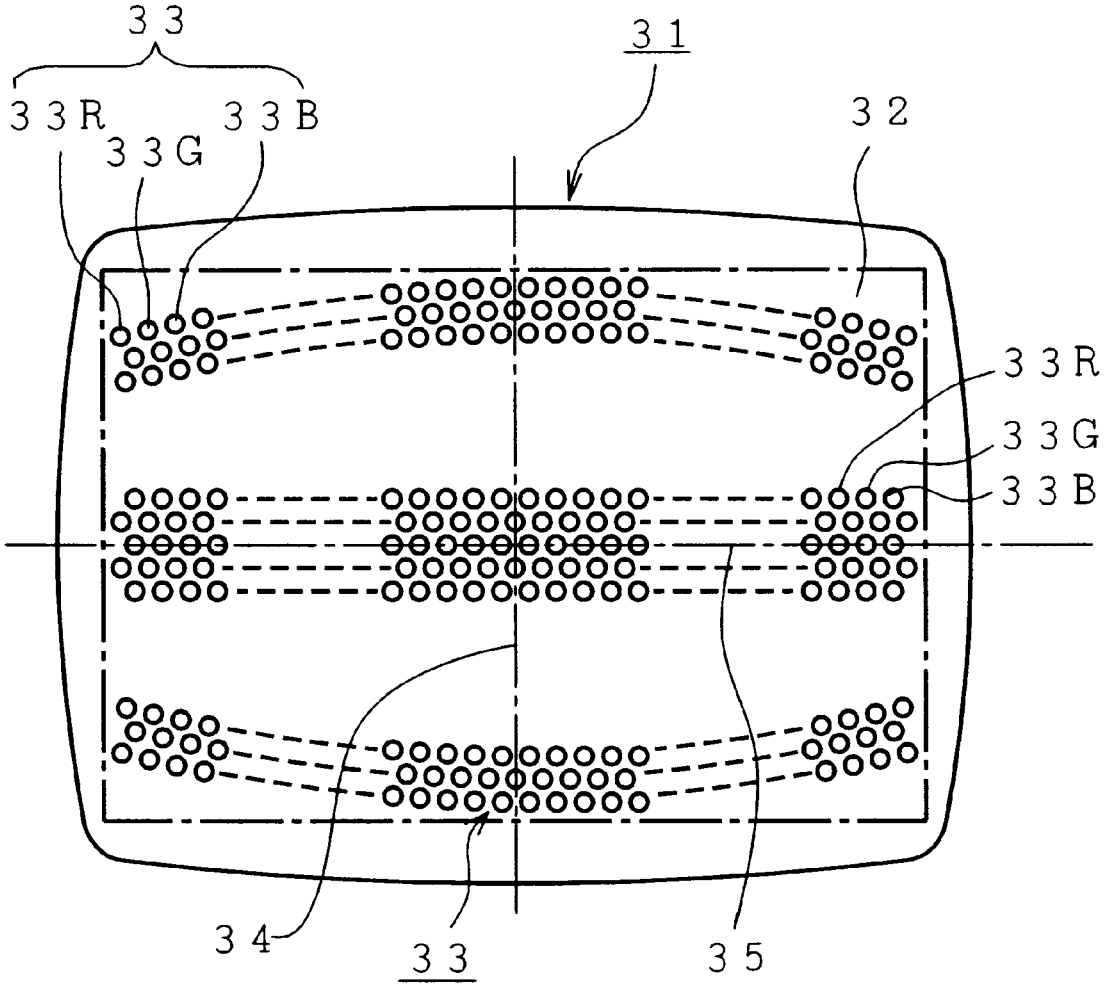
FIG. 5 (PRIOR ART)
FIG. 5 is a schematic configuration view showing an arrangement of phosphor dots of the phosphor screen of a cathode ray tube employing a prior art shadow mask (disclosed in Japanese Patent Laid-Open Publication No. SHO 56-41648).

FIGS. 4A, 4B and 4C are views showing variations in pitches of the phosphor dots of the phosphor screen formed on the inner surface of the faceplate of the panel portion for use in the color cathode ray tube employing the shadow mask as shown in FIGS. 2A and 2B, wherein FIG. 4A shows the horizontal dot pitches, and FIGS. 4B and 4C show the vertical dot pitches.

In FIG. 3, character Ph designates a horizontal dot pitch; Pv is a vertical dot pitch; and Pd is a diagonal dot pitch. Although not shown in FIG. 3, character Pdo designates diagonal dot pitch in the central portion of the useful phosphor screen area. Further, reference numeral 23R designates red phosphor dots; 23G is green phosphor dots; and 23B is blue phosphor dots.

In FIG. 4A, the abscissa designates a distance from the vertical center line toward the left or right side of the useful phosphor screen area, and the ordinate is the horizontal dot pitches Ph of the phosphor dots 23. In FIGS. 4B and 4C, the abscissa designates a distance from the vertical center line toward the left or right side of the useful phosphor screen area, and the ordinate is the vertical dot pitches Pv of the phosphor dots 23. Xi designates the left or right side of the useful phosphor screen area in each of FIGS. 4A, 4B and 4C.

The dot pitches of the phosphor dots 23 formed in the useful phosphor screen area in this embodiment is required to satisfy, in addition to the above-described varied pitch arrangement and tilt array arrangement, the following relationship (1) for making the diagonal dot pitches Pd substantially uniform in each portion in the useful phosphor screen area. Specifically, as shown in FIG. 3, the dot pitches of the phosphor dots 23 are arranged in such a manner as to satisfy the relationship (1):

$$0.98\ Pdo \leq Pd \leq 1.02\ Pdo \quad (1)$$

where $Pd=\{Ph^2+Pv^2\}^{0.5}$

In the relationship (1), the vertical dot pitch Pv is defined as a vertical distance between one horizontal row of phosphor dots 23R, 23G and 23B and an other horizontal row of phosphor dots 23R, 23G and 23B and adjacent to the one row of phosphor dots 23R, 23G and 23B; the horizontal dot pitch Ph is defined as a horizontal distance between a first phosphor dot of a first color (a green phosphor dot 23G, for example) in the one horizontal row and a second phosphor dot of the first color in the other horizontal row and nearest the first phosphor dot; a diagonal dot pitch Pd is defined as a diagonal distance between the first phosphor dot and the second phosphor dot; and a central diagonal dot pitch Pdo is a diagonal dot pitch Pd at the center of the useful phosphor screen area.

In this case, it is possible to make substantially uniform the diagonal dot pitches Pd in each portion in the useful phosphor screen area without incurring complications by selecting the diagonal dot pitches Pd everywhere in the useful phosphor screen area at a value in a range of 0.98 to 1.02 times the diagonal dot pitches Pdo in the center portion of the useful phosphor screen area.

The phosphor screen having such a configuration, as shown in FIG. 4A, is configured such that the horizontal dot pitches Ph are nearly uniform in a central region Hc within a distance of Xc from the vertical center line as one goes from the vertical center line toward the left or right side of the useful phosphor screen area, and increase slightly in a region Hi outside of the central region Hc as one goes toward the sides of the useful phosphor screen area.

Meanwhile, the vertical phosphor dot pitches Pv decrease monotonically gradually as one goes from the vertical center line toward the left or right side of the useful phosphor screen area to form a tilt array arrangement, as shown in FIG. 4B.

As shown in FIG. 4C, the vertical dot pitches Pv can also be configured such that the vertical dot pitches Pv are nearly uniform in a central region Vc within a distance of Xc from the vertical center line as one goes from the vertical center line toward the left or right side of the useful phosphor screen area, and then decrease slightly in a region Vi outside of the central region Vc as one goes toward the left or right side of the useful phosphor screen area.

That the horizontal phosphor dot pitch Ph is "nearly uniform" in the central region Hc means that a variation of Ph from 1.0 Pho to 1.01 Pho in the central region Hc can be accepted as a manufacturing tolerance, when Pho is defined as the minimum value of Ph in the central region Hc.

It is preferable that the central region Hc extends not less than about two-thirds, but not more than about five-sixths of the distance from the vertical center line to the left or right side of the useful phosphor screen area. If the central region Hc has a dimension smaller than the above dimension, the phosphor dot pitches become too coarse in the critical area of the phosphor screen, resulting in pronounced deterioration in resolution and poor display quality of the color cathode ray tube.

On the other hand, if the central region Hc extend to more than about five-sixths of the distance from the vertical center line, diagonal phosphor dot pitches cannot be made sufficiently large at the left or right side of the useful phosphor screen area and the color purity tolerance decreases particularly at the corners of the phosphor screen, resulting in deterioration of color uniformity, the color purity tolerance being defined as a distance an electron beam can move before it reaches an adjacent phosphor dot of an unintended color.

The horizontal dot pitch Phi at the sides of the useful phosphor screen area is preferably in a range of about 1.03 Pho to about 1.08 Pho.

That the vertical phosphor dot pitch Pv is "nearly uniform" in the central region Vc means that a variation of Pv from 0.995 Pvo to 1.0 Pvo in the central region Vc can be accepted as a manufacturing tolerance, when Pvo is defined as the maximum value of Pv in the central region Vc.

It is preferable that the central region Vc extends not more than about two-thirds of the distance from the center to the left or right side of the useful phosphor screen area.

If the central region Vc extend to more than about two-thirds of the distance from the vertical center line to the sides of the useful phosphor screen area, vertical phosphor dot pitches cannot be made sufficiently small at the left or right side of the useful phosphor screen area and the sufficient tilt of the horizontal direction of the line triads of three phosphor dots of different colors (the arrangement of the tilt array of three-color phosphor dots) cannot be obtained particularly at the corners of the phosphor screen, resulting in decrease in color purity tolerance and subsequent deterioration of color uniformity.

The vertical dot pitch Pvi at the left or right side of the useful phosphor screen area is preferably in a range of about 0.935 PVo to about 0.985 Pvo.

While FIGS. 4A, 4B and 4C illustrate variations in pitches of the phosphor dots of the phosphor screen, the pitches of the beam apertures of the shadow mask have the same pitch arrangement and characteristics as those of the pitches of the phosphor dots of the phosphor screen.

As described above, according to this embodiment, since the dot pitches of the phosphor dots 23 formed in the useful phosphor screen area are arranged on the basis of the varied pitch arrangement and the tilt array arrangement, the varied pitch arrangement cancels the decrease in the diagonal dot pitches Pd of the phosphor dots 23 at the corners of the useful phosphor screen area caused by the tilt array arrangement, and further, the above-described relationship (1) makes substantially uniform the diagonal dot pitches Pd of the phosphor dots 23 in each portion of the useful phosphor screen area.

Since the diagonal dot pitches Pd of the phosphor dots 23 in each portion of the useful phosphor screen area 5U are made substantially uniform, a color purity tolerance increases in the useful phosphor screen area, resulting in prevention of local deterioration in resolution.

Further, according to this embodiment, there can be obtained the shadow mask 5 having a high mechanical strength by adopting the varied aperture pitch arrangement for the shadow mask 5.

As described above, according to the shadow mask type color cathode ray tube, a multiplicity of beam apertures are formed in the apertured portion of the shadow mask such that the vertical pitches of the beam apertures are arranged to form the tilt array arrangement, and the horizontal pitches of the beam apertures are nearly uniform in a central portion on both sides of and in the neighborhood of the vertical center line of the apertured portion and increase slightly as one goes out of the central portion toward the left or right side of the apertured portion 5U to form a varied pitch arrangement. Accordingly, the varied pitch arrangement of the beam apertures cancels the decrease in diagonal pitches of the phosphor dots at the corners of the phosphor screen caused by the tilt array arrangement of the aperture pitches, to prevent local decrease in diagonal pitches of the phosphor dots. Also, the relationship (1) between the horizontal dot pitch Ph, vertical dot pitch Pv, diagonal dot pitch Pd, and central diagonal dot pitch Pdo makes the diagonal pitches of the phosphor dots substantially uniform over the entire useful phosphor screen area. As a result, a color purity tolerance increases at each portion in the useful phosphor screen area, and local deterioration in resolution is prevented.

According to the shadow mask type color cathode ray tube of the present invention, the varied pitch arrangement adopted for the shadow mask is effective to increase the mechanical strength of the shadow mask.

What is claimed is:

1. A color cathode ray tube comprising an evacuated envelope including a panel portion, a neck portion and a funnel portion for connecting said panel portion and said neck portion, said panel portion including a faceplate, a plural-color phosphor screen formed on an inner surface of said faceplate, said plural-color phosphor screen including a multiplicity of phosphor dots of a plurality of colors, a shadow mask having a multiplicity of apertures therein and spaced from said phosphor screen, and said neck portion having a plural-beam in-line type electron gun housed therein;

said plural-color phosphor screen being configured such that a first horizontal phosphor dot pitch Ph on a horizontal center line of a useful area of said phosphor screen at a first predetermined distance from a center of said useful area of said phosphor screen toward sides of said useful area is less than or equal to 101% of a second horizontal phosphor dot pitch Ph at said center of said useful area, said first predetermined distance being two-thirds of a distance from said center of said useful area to said sides of said useful area, a third horizontal phosphor dot pitch Ph at corners of said useful area being larger than said second horizontal phosphor dot pitch Ph at said center of said useful area, and a first vertical phosphor dot pitch Pv at said corners of said useful area being smaller than a second vertical phosphor dot pitch Pv at said center of said useful area;

wherein a vertical phosphor dot pitch Pv is defined as a vertical distance between a first horizontal row of said multiplicity of said phosphor dots and a second horizontal row of said multiplicity of said phosphor dots adjacent to said first horizontal row, and a horizontal phosphor dot pitch Ph is defined as a horizontal distance between a first phosphor dot of a first color of said plurality of colors in said first horizontal row and a second phosphor dot of said first color in said second horizontal row which is nearest to said first phosphor dot.

2. A color cathode ray tube according to claim 1, wherein a diagonal phosphor dot pitch Pd at said corners of said useful area satisfies a following relationship:

$$0.98\ Pdo \leqq Pd \leqq 1.02\ Pdo$$

wherein said diagonal phosphor dot pitch Pd is defined as a diagonal distance between said first phosphor dot and said second phosphor dot, and Pdo is a diagonal phosphor dot pitch Pd at the center of said useful area.

3. A color cathode ray tube according to claim 1, wherein said first horizontal phosphor dot pitch Ph on said horizontal center line of said useful area at said sides of said useful area is in a range of about 1.03 to about 1.08 times said second horizontal phosphor dot pitch Ph at said center of said useful area.

4. A color cathode ray tube according to claim 1, wherein said first vertical phosphor dot pitch Pv on said horizontal center line of said useful area at said sides of said useful area is in a range of about 0.935 to about 0.985 times said second vertical phosphor dot pitch Pv at said center of said useful area.

5. A color cathode ray tube comprising an evacuated envelope including a panel portion, a neck portion and a funnel portion for connecting said panel portion and said neck portion, said panel portion including a faceplate, a plural-color phosphor screen formed on an inner surface of said faceplate, said plural-color phosphor screen including a multiplicity of phosphor dots of a plurality of colors, a shadow mask having a multiplicity of apertures therein and spaced from said phosphor screen, and said neck portion having a plural-beam in-line type electron gun housed therein;

said shadow mask being configured such that a first horizontal aperture pitch on a horizontal center line of a useful apertured portion of said shadow mask at a first predetermined distance from a center of said useful apertured portion of said shadow mask toward sides of said useful apertured portion is less than or equal to 101% of a second horizontal aperture pitch at said center of said useful apertured portion, said first predetermined distance being two-thirds of a distance from said center of said useful apertured portion to said sides of said useful apertured portion, a third horizontal aperture pitch at corners of said useful apertured portion being larger than said second horizontal aperture pitch at said center of said useful apertured portion, and a first vertical aperture pitch at said corners of said useful apertured portion being smaller than a second vertical aperture pitch at said center of said useful apertured portion.

6. A color cathode ray tube according to claim 5, wherein said first horizontal aperture pitch on said horizontal center line of said useful apertured portion at said sides of said useful apertured portion is in a range of about 1.03 to about 1.08 times said second horizontal aperture pitch at said center of said useful apertured portion.

7. A color cathode ray tube according to claim 5, wherein said first vertical aperture pitch on said horizontal center line of said useful apertured portion at said sides of said useful apertured portion is in a range of about 0.935 to about 0.985 times said second vertical aperture pitch at said center of said useful apertured portion.

* * * * *